US007919708B2

(12) United States Patent
Komatsu

(10) Patent No.: US 7,919,708 B2
(45) Date of Patent: Apr. 5, 2011

(54) ELECTRONIC MUSICAL INSTRUMENT

(75) Inventor: Akihiko Komatsu, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 12/722,969

(22) Filed: Mar. 12, 2010

(65) Prior Publication Data

US 2010/0236388 A1 Sep. 23, 2010

(30) Foreign Application Priority Data

Mar. 17, 2009 (JP) ..... 2009-063970

(51) Int. Cl.
*G10H 1/34* (2006.01)
*G10H 3/00* (2006.01)
*G10F 1/02* (2006.01)

(52) U.S. Cl. ..... 84/746; 84/13; 84/21

(58) Field of Classification Search ..... 84/13, 21, 84/626, 746

See application file for complete search history.

(56) References Cited

U.S. PATENT DOCUMENTS

| | | | | |
|---|---|---|---|---|
| 5,922,983 | A | 7/1999 | Muramatsu | |
| 6,392,136 | B2 * | 5/2002 | Kondo et al. | 84/718 |
| 7,332,669 | B2 * | 2/2008 | Shadd | 84/742 |
| 7,432,428 | B2 * | 10/2008 | Kunisada et al. | 84/13 |
| 7,804,017 | B2 * | 9/2010 | Hata et al. | 84/644 |
| 2001/0052284 | A1 * | 12/2001 | Kondo et al. | 84/718 |
| 2003/0015086 | A1 * | 1/2003 | Katz | 84/644 |
| 2007/0017353 | A1 * | 1/2007 | Kunisada et al. | 84/723 |
| 2009/0241756 | A1 * | 10/2009 | Tajima et al. | 84/604 |

FOREIGN PATENT DOCUMENTS

JP 2006-146259 A 6/2006

* cited by examiner

*Primary Examiner* — Jeffrey Donels
(74) *Attorney, Agent, or Firm* — Morrison & Foerster LLP

(57) ABSTRACT

A computer portion 70 determines main reaction force RF0 by use of a main reaction force table storing main reaction forces which vary according to the velocity and the depth of a depression of the key 11. The computer portion 70 determines first ancillary reaction force RF1 by use of a first ancillary reaction force table storing first ancillary reaction forces which vary according to the amount of depression of a lever 32 of a pedal apparatus 30. The computer portion 70 adds the first ancillary reaction force RF1 to the main reaction force RF0 to obtain a composite reaction force to control a solenoid 21 on the basis of the composite reaction force so that a reaction force which is to be exerted on the key 11 will be the composite reaction force.

12 Claims, 7 Drawing Sheets

ELECTRONIC MUSICAL INSTRUMENT

BACKGROUND OF THE INVENTION

1. Field of the Invention

The present invention relates to an electronic musical instrument which exerts, on a key, a reaction force opposing a player's depression and release of the key so that the player can perceive a sense of manipulating the key similar to that perceived when he plays the acoustic piano.

2. Description of the Related Art

Conventionally, electronic musical instruments have been designed to provide a player of the conventional electronic musical instrument with the sense of manipulating a key which is similar to that provided by an acoustic piano. For instance, Japanese Unexamined Patent Publication No. 2006-146259 discloses an apparatus which has reaction force tables in which reaction forces varying according to the amount of manipulation of each key are stored for each key in order to exert a reaction force on the manipulated key. The conventional apparatus is designed to detect the amount of manipulation of each key during player's performance of a song to refer to the reaction force tables to obtain a reaction force which is to be exerted on the key. More specifically, the conventional apparatus is configured to refer to the reaction force tables to obtain a reaction force which is to be exerted on a key, also controlling a driving signal which is to be supplied to a solenoid for applying a reaction force to the key in accordance with the obtained reaction force.

SUMMARY OF THE INVENTION

The characteristics of reaction force of a key of an acoustic piano will now be explained. FIG. 6 indicates static load curves of a key of an acoustic piano (characteristics of reaction force with respect to the depth of a depressed key of a case where the key is depressed or released very slowly by a player). If the front end of a key is lowered below fiducial position P0 by a depression of the key, a capstan provided for the key starts raising a hammer via a wippen, a jack and the like. As a result, because of weights of respective parts of a hammer action of the key, the elasticity of the parts, friction produced between the parts, and the like, the reaction force of the key increases. If the depth of the depressed key (the displacement of the key from the fiducial position) reaches first depth P1 (e.g., about 1 mm), the rear end of the key comes into contact with a damper action to start lifting a damper. By the weight of the damper, friction produced between the damper and a string, and the like, as a result, the reaction force of the key further increases. If the depth of the depressed key then reaches second depth P2 (e.g., about 2 mm), the damper fully leaves the string without increase in the reaction force. Therefore, in a case where a lever of a damper pedal is depressed to lift the damper fully, any reaction force caused by the damper will not be exerted on the key, as indicated by dashed lines in FIG. 6. In a case such as half pedal where the damper pedal is depressed part way to lift the damper slightly, the depth of the depressed key at the time of contact of the key with the damper action to start lifting the damper (that is, at the time when the reaction force of the key starts increasing because of the damper) is greater than a state where the lever of the damper pedal is not being depressed as indicated by dashed dotted line in FIG. 6.

If the key is depressed further, so that the depth of the depressed key reaches third depth P3 (e.g., about 6 mm), the jack starts leaving a hammer roller. As a result, the reaction force of the key sharply increases. If the key is then depressed further, so that the depth of the depressed key reaches fourth depth P4 (e.g., about 8 mm), the hammer leaves the jack. As a result, the reaction force of the key starts decreasing sharply. In the latter part of the depression of the key, the player feels the key suddenly becoming light. This feeling is referred to as let-off feeling. The let-off feeling has a large influence on the player's sense of manipulating a key. If the key then comes into contact with a stopper which restricts downward displacement of the key, the reaction force of the key sharply increases again.

During a release of the key, the key and the above-described constituents operate in the order opposite to that in which the key and the constituents have operated during the depression of the key, returning to an initial state. However, when the key is released, the jack returns to its original position with the hammer being lifted by a repetition lever. Therefore, even if the depth of the depressed, key is in the third depth P3 (e.g., about 6 mm), the reaction force will not increase sharply. In addition, the key is connected not only to the above-described parts such as jack, wippen and damper but also to a plurality of movable parts, cushion members and the like. Because of viscosity and friction of the various parts of the keyboard, as a result, hysteresis occurs in a reaction force with respect to the depth of a depressed key as indicated in FIG. 6.

As described above, the acoustic piano provides the player with the sense of manipulating a key which varies according to the amount of depression of the damper pedal (displacement of the lever from the initial state). In addition, variations in the models and manufacturers of piano, and the like link to variations in escapement action, resulting in variations in the let-off feeling. The above-described conventional electronic musical instrument is configured such that in order to reproduce the different senses of manipulating a key between the on-state and off-state of the damper pedal, the reaction force tables are provided for the on-state and the off-state of the damper pedal, respectively, to switch between the reaction force tables depending on the on/off of the damper pedal. Therefore, the configuration of the reaction force tables of the conventional electronic musical instrument is complicated.

The present invention was accomplished to solve the above-described problem, and an object thereof is to provide an electronic musical instrument in which reaction forces calculated by use of reaction force tables are exerted on keys in order to realize the sense of manipulating the keys similar to that of manipulating keys of an acoustic piano, with the configuration of the reaction force tables being simple.

In order to achieve the above-described object, it is a feature of the present invention to provide an electronic musical instrument having a key manipulated by a player; a physical quantity sensor for sensing physical quantity concerning manipulation of the key; a reaction force applying device for applying a reaction force opposing the player's manipulation of the key to the key; an operator manipulated by the player to affect manipulation of the key according to the amount of manipulation of the operator; and an operator manipulated amount sensor for sensing the amount of manipulation of the operator; a main reaction force determining potion for determining, by use of a main reaction force table storing main reaction forces which vary according to the physical quantity concerning manipulation of the key, a main reaction force corresponding to the sensed physical quantity concerning manipulation of the key; a first ancillary reaction force determining portion for determining, by use of a first ancillary reaction force table storing first ancillary reaction forces which vary according to the physical quantity concerning manipulation of the key and the amount of manipulation of the operator, a first ancillary reaction force corresponding to the sensed physical quantity concerning manipulation of the key and the sensed amount of manipulation of the operator; and a reaction force controller for adding the determined first ancillary reaction force to the determined main reaction force to calculate a composite reaction force to control the reaction force applying device on the basis of the composite reaction force so that the reaction force opposing the player's manipulation of the key will be the composite reaction force. In this case, the physical quantity concerning manipulation of the key is at least, the depth of a depression of the key, the velocity of the depression of the key or the acceleration of the depression of the key. Furthermore, the operator may be a damper pedal; and the amount of manipulation of the operator may be the amount of depression of the damper pedal. In addition, the physical quantity concerning manipulation of the key may be depth of a depression of the key; and the first ancillary reaction forces may be designed such that the depth of a depression of the key at which the first ancillary reaction force starts to emerge varies according to the amount of depression of the damper pedal.

The electronic musical instrument configured as described above is provided with the main reaction force table storing the main reaction forces which vary according to the physical quantity concerning manipulation of the key. In addition, the electronic musical instrument is also provided with the first ancillary reaction force table storing the ancillary reaction forces which vary according to the physical quantity of the key and the amount of manipulation of the operator. By use of the main reaction force table and the first ancillary reaction force table, the electronic musical instrument determines the main reaction force and the first ancillary reaction force to add the first ancillary reaction force to the main reaction force to calculate the composite reaction force representative of a reaction force which is to be exerted on the key. Compared with the conventional electronic musical instrument which stores tables equivalent to the main reaction force table of the present invention for respective amounts of manipulation of the operator to switch the tables according to the amount of manipulation of the operator to calculate a reaction force which is to be exerted on a key, the configuration of the tables of the electronic musical instrument of the present invention is simple. In a case where the electronic musical instrument is configured such that, the operator is a damper pedal, so that the operator manipulated amount sensor senses whether the damper pedal is in the on-state or the off-state, for example, the conventional electronic musical instrument has to have the tables equivalent to the main reaction force table of the present invention (the tables of FIG. 4A) for the on-state and the off-state of the damper pedal, respectively. However, the electronic musical instrument of the present invention requires employment only of the on-state and the off-state of the damper pedal as the amount of depression of the damper pedal. In this case, the electronic musical instrument of the present invention may be provided with one main reaction force table and one first ancillary reaction force table having data on the first ancillary reaction forces of the two states of on-state and off-state of the damper pedal (in FIG. 4B, a table having data only on the two states of on-state and off state of the damper pedal). Compared with the configuration of the tables of the conventional electronic musical instrument, therefore, the configuration of the tables formed of the above-described main reaction force table and the first ancillary reaction force table of the present invention is simple.

In a case where the electronic musical instrument is configured such that the above-described operator is a damper pedal, so that the operator operated amount sensor senses the amount of depression of the damper pedal, with the first ancillary reaction force being designed such that the depth of a depression of the key at which the first ancillary reaction force starts to emerge varies according to the amount of depression of the damper pedal, such an electronic musical instrument is able to reproduce the characteristic of reaction force of a key of an acoustic piano in which the reaction force which is to be exerted on the key varies according to the amount of depression of a damper pedal. In this case, therefore, by such a simple configuration, the electronic musical instrument of the present invention is able to provide the player with the sense of manipulating the keys which is closer to that provided by an acoustic piano.

It is another feature of the present invention that the physical quantity concerning manipulation of the key is depth of a depression of the key and velocity of the depression of the key or acceleration of the depression of the key. This feature enables more faithful reproduction of the characteristic of reaction force of acoustic piano in which the reaction force varies according to the depth of a depression of the key and the velocity of a key-depression or the acceleration of a key-depression. By such a simple configuration, therefore, the electronic musical instrument according to this feature is able to provide the player with the sense of manipulating the keys which is closer to that provided by the acoustic piano.

It is a further feature of the present invention to provide the electronic musical instrument further including a second ancillary reaction force determining portion for determining, by use of a second ancillary reaction force table storing second ancillary reaction forces which vary according to the depth of a depression of the key, a second ancillary reaction force corresponding to the depth of a depression of the key sensed by the physical quantity sensor, wherein the reaction force controller adds the determined second ancillary reaction force to the composite reaction force to calculate a new composite reaction force to control the reaction force applying device on the basis of the new composite reaction force so that the reaction force opposing the player's manipulation of the key will be the new composite reaction force. In this case, the electronic musical instrument may further include a setting operator for adjusting the reaction force opposing the player's manipulation of the key, wherein the second ancillary reaction force determining portion has a varying portion for varying the second ancillary reaction force determined by use of the second ancillary reaction force table according to a manipulated state of the setting operator.

The electronic musical instrument configured as described above is able to reproduce the let-off feeling which emerges in the latter part of a depression of the key, by storing, as the second ancillary reaction force table, the characteristic of reaction force attributed to the escapement action of an acoustic piano. Furthermore, the electronic musical instrument is allowed to change the second ancillary reaction force according to the state of manipulation of the setting operator to allow reproduction of various let-off feelings of the keys of various acoustic pianos having different escapement actions, enabling the player to control the magnitude of the let-off feeling.

DESCRIPTION OF THE PREFERRED EMBODIMENT

Figure 1:
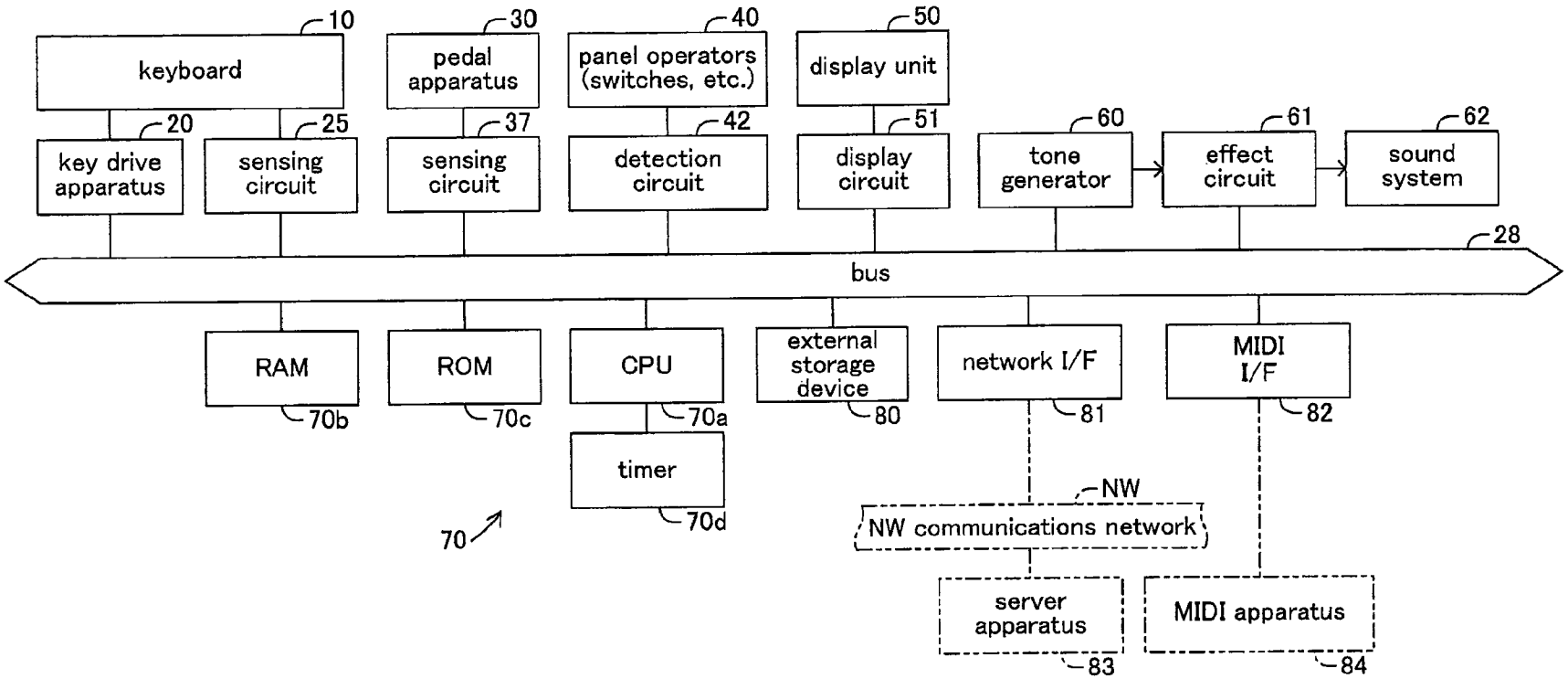
FIG. 1 is a block diagram indicating an example general configuration of an electronic musical instrument according to an embodiment of the present invention.

The configuration of the electronic musical instrument according to the embodiment of the present invention will now be described with reference to FIG. 1 and FIG. 2. This electronic musical instrument has a keyboard 10, a key drive apparatus 20, a pedal apparatus 30, panel operators 40, a display unit 50, a tone generator 60 and a computer portion 70.

The keyboard 10, which is manipulated with player's hands, has a plurality of keys 11 each of which specifies a tone pitch of a musical tone to be generated. The keys 11 are formed in one long piece of synthetic resin. As indicated in FIG. 2, each key 11 is supported by a key supporting portion 12 provided on a frame FR so that the front end of each key 11 can pivot upward and downward about a rotation pivot 13 provided on the rear end of the key 11. From the undersurface of a middle part of the key 11, a stopper piece 14 extends downward to be integral with the key 11. The lower part of the stopper piece 14 is bent backward to have a jutting portion 14*a*. Above the jutting portion 14*a*, an upper limit stopper 15 is coupled to the frame FR so that the upper limit stopper 15 will restrict upward displacement of the front end of the key 11 by contact of the upper limit stopper 15 with the top surface of the jutting portion 14*a*. Below the jutting portion 14*a*, a lower limit stopper 16 is coupled to the frame FR so that the lower limit stopper 16 will restrict downward displacement of the front end of the key 11 by contact of the lower limit stopper 16 with the undersurface of the jutting portion 14*a*. The upper limit stopper 15 and the lower limit stopper 16 are formed of a long flat-shaped cushioning material (e.g., felt) extending sideward (perpendicular to the surface of paper) in order to alleviate shocks caused by collisions with the upper surface and undersurface of the jutting portion 14*a*. The frame FR is a structure for supporting various parts of the electronic musical instrument of the embodiment and a housing of the electronic musical instrument. The electronic musical instrument may not have the stopper pieces 14. In this case, the electronic musical instrument may be provided with an upper limit stopper and a lower limit stopper which come into contact with the undersurface and the top surface of the keys 11, respectively, to restrict a range in which each of the keys 11 can pivot.

Below a middle part of the key 11, a spring 17 is provided. The lower end of the spring 17 is rigidly coupled to the frame FR placed below the key 11. The upper end of the spring 17 is in contact with the undersurface of the middle part of the key 11, so that the spring 17 urges the front end of the key 11 upward. The electronic musical instrument may be modified to have a lever, a massive body or the like which moves in response to the pivoting of the key 11 so that the weight of the lever or massive body will urge the front end of the key 11 upward.

Figure 2:
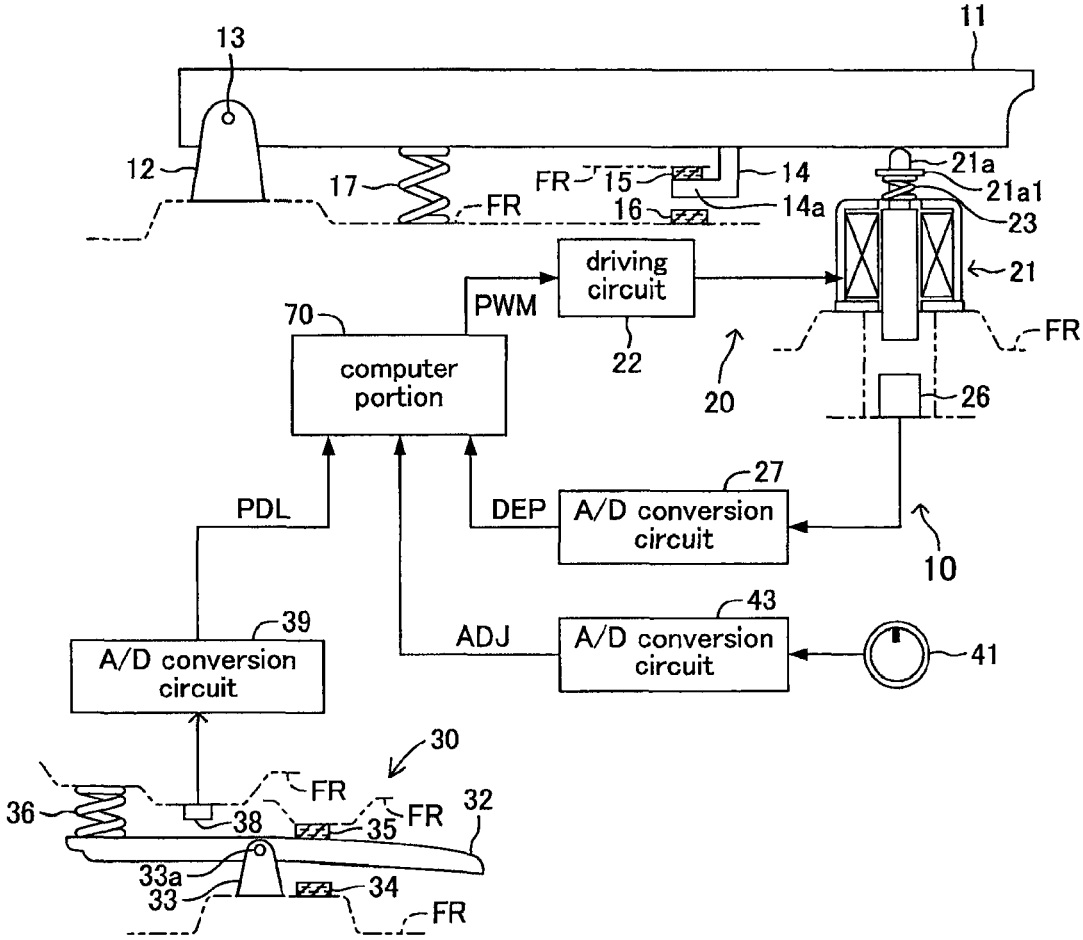
FIG. 2 is a diagram concretely indicating a part concerning a keyboard, a key drive apparatus, a pedal apparatus and panel operators of the electronic musical instrument indicated in FIG. 1.

The key drive apparatus 20 is formed of a solenoid 21 provided below the front end of the key 11 and a driving circuit 22 for driving the solenoid 21 as indicated in FIG. 2. The key drive apparatus 20 is equivalent to reaction force applying device of the present invention. The lower end of the solenoid 21 is rigidly coupled to the frame FR placed below the key 11. A plunger 21*a* of the solenoid 21 is allowed to move upward and downward. Although the plunger 21*a* is shaped like a cylinder, a part of the upper part of the plunger 21*a* is provided with a circular thin plate 21*a*1 of larger diameter than other parts of the plunger 21*a* to have a spring 23 between the undersurface of the circular plate 21*a*1 and a frame of the solenoid 21. The plunger 21*a* is urged upward by the spring 23, so that the top end of the plunger 21*a* is in contact with the undersurface of the key 11 at all times. The spring force of the spring 23 is too small to affect a reaction force which opposes player's manipulation of depressing/releasing the key 11. This embodiment may be modified such that the solenoid 21 is placed behind the key supporting member 12, with the solenoid 21 being turned upside down to be situated on the top surface of the key 11. Such a modified arrangement allows contact of the plunger 21*a* with the top surface of the key 11 because of the weight of the plunger 21 even in a state where the solenoid 21 is not being driven, eliminating the need for the spring 23.

The driving circuit 22 generates a pulse-width modulation signal (hereafter referred to as PWM signal) on the basis of a command value supplied from the later-described computer portion 70 to supply the generated PWM signal to the solenoid 21 to drive the solenoid 21. More specifically, as the pulse width of the PWM signal increases, the plunger 21*a* exerts a greater force to press up the front end of the key 11. By this configuration, as the pulse width of the PWM signal increases, the solenoid 21 exerts, on the key 11, a greater reaction force opposing the player's manipulation of depressing/releasing the key 11.

A sensing circuit 25 is formed of a key-depression depth sensor 26 for sensing the vertical position of the front end of the key 11 and an ND conversion circuit 27. The sensing circuit 25 is equivalent to a physical quantity sensor of the present invention. The key-depression depth sensor 26, which is rigidly coupled to the frame FR situated beneath the plunger 21*a*, senses the distance to the undersurface of the plunger 21*a* electrically or optically (e.g., by reflection of laser light). Because the top end of the plunger 21*a* is in contact with the undersurface of the key 11 at all times, as described above, the depth of a depression of the key 11 can be derived from the distance to the plunger 21*a* sensed by the key-depression depth sensor 26. The key-depression depth sensor 26 may be replaced with a sensor for mechanically and electrically sensing the vertical position of the plunger 21*a* (e.g., by variable resistance). The depth of the key-depression sensed by the key-depression depth sensor 26 is converted into a digital signal indicative of key-depression depth DEP by the ND conversion circuit 27 to be supplied to the later-described computer portion 70 via a bus 28. There is no need to provide the A/D conversion circuit 27 for each key 11. That is, the ND conversion circuit 27 may be shared by the respective keys 11. In an initial state (in a state where the key 11 is not being depressed), the key-depression depth DEP is "0". As the amount of displacement of the key 11 increases from the initial state, the key-depression depth DEP increases.

The pedal apparatus 30, which is manipulated with a player's foot, controls the manner in which a musical tone of the electronic musical instrument is generated. A lever 32 of the pedal apparatus 30 is formed of a long plate-like member. The forward part of the lever 32 (the right side in FIG. 2) is a broad pedal portion which the player depresses. On the middle part of the lever 32, the lever 32 is supported by a lever supporting portion 33 provided on the frame FR so that the front end of the lever 32 can vertically pivot about a rotation pivot 33*a*. Below the middle part of the lever 32, a long lower limit stopper 34 formed of a shock absorbing member such as felt extends laterally, being rigidly coupled to the frame FR. The lower limit stopper 34 restricts downward displacement of the forward part of the lever 32. Above the middle part of the lever 32, an upper limit stopper 35 similar to the lower limit stopper 34 is rigidly coupled to the frame FR to restrict upward displacement of the forward part of the lever 32. Behind the rotation pivot 33*a*, a spring 36 is provided to be situated on the rear part of the lever 32. The top end of the spring 36 is rigidly coupled to the frame FR. The lower end of the spring 36 is in contact with the top surface of the rear part of the lever 32 to urge the forward part of the lever 32 upward.

A sensing circuit 37 is formed of a pedal depressed amount sensor 38 for sensing the amount of depression of the lever 32 and an ND conversion circuit 39. The sensing circuit 37 is equivalent to a operator manipulated amount sensor of the present invention. The pedal depressed amount sensor 38, which is provided above the middle part of the lever 32, senses the distance to the top surface of the lever 32 electrically or optically (e.g., by reflection of laser light) to obtain the amount of depression of the lever 32. The pedal depressed amount sensor 38 may be replaced with a sensor for mechanically and electrically sensing the amount of depression of the lever 32 (e.g., by variable resistance). The amount of depression of the lever 32 is converted into a digital signal indicative of pedal depressed amount PDL by the A/D conversion circuit 39 to be supplied to the later-described computer portion 70 via the bus 28. In an initial state (in a state where the lever 32 is not being depressed), the pedal depressed amount PDL is "0". As the amount of displacement of the lever 32 increases from the initial state, the pedal depressed amount PDL increases.

The panel operators 40 are the operators for programming operations of the electronic musical instrument. The panel operators 40 include a let-off feeling setting operator 41 for adjusting let-off feeling. In this embodiment, the let-off feeling setting operator 41 is a rotary volume which outputs a voltage signal that varies according to variations in resistance value corresponding to the rotation angle of the rotary volume. However, the let-off feeling setting operator 41 may be a rotary encoder, a slide volume, a linear encoder, a switch, or the like. A detection circuit 42, which senses manipulation of the panel operators 40, includes an A/D conversion circuit 43 indicated in FIG. 2. The ND conversion circuit 43 converts the voltage signal transmitted from the let-off feeling setting operator 41 into a digital signal indicative of let-off feeling set value ADJ to supply the converted digital signal to the later-described computer portion 70 via the bus 28. If the voltage signal transmitted from the let-off feeling setting operator 41 is "0", the let-off feeling set value ADJ is "0". As the voltage value increases, the let-off feeling set value ADJ increases.

The display unit 50, which is formed of a liquid crystal display, CRT or the like, displays characters, numerics, graphics and the like on a screen. The display unit 50 is controlled by a display circuit 51 connected to the bus 28 so that what is displayed will be specified on the basis of display signals and data supplied to the display circuit 51 via the bus 28.

The tone generator 60, which is connected to the bus 28, generates digital musical tone signals on the basis of musical tone control data (note data, key-on data, key-off data, tone color control data, tone volume control data and the like) supplied from the later-described computer portion 70 via the bus 28 to supply the generated digital musical tone signals to an effect circuit 61. The effect circuit 61, which is connected to the bus 28, adds effects to the supplied digital musical tone signals on the basis of effect control data supplied from the computer portion 70 via the bus 28 to supply the digital musical signals to a sound system 62. The sound system 62, which is formed of a D/A converter, amplifiers, speakers and the like, converts the supplied digital musical tone signals to which the effects have been added into analog musical tone signals to emit musical tones corresponding to the analog musical tone signals.

The computer portion 70, which is formed of a CPU 70*a*, a RAM 70*b*, a ROM 70*c* which are connected to the bus 28 as well as a timer 70*d* connected to the CPU 70*a*, carries out programs to control the electronic musical instrument.

The electronic musical instrument also has an external storage device 80, a network interface circuit 81 and a MIDI interface circuit 82. The external storage device 80 includes various kinds of storage media such as a hard disk and a flash memory incorporated into the electronic musical instrument and a compact disk which is connectable to the electronic musical instrument, and drive units provided for the storage media, enabling the electronic musical instrument to store and read out large amounts of data and programs. The network interface circuit 81 allows the electronic musical instrument to connect to a server apparatus 83 through a communications network NW so that the electronic musical instrument can communicate with the server apparatus 83. The MIDI interface circuit 82 allows the electronic musical instrument to connect to an external MIDI apparatus 84 such as another electronic musical instrument or a sequencer so that the electronic musical instrument can communicate with the external MIDI apparatus 84.

Figure 3:
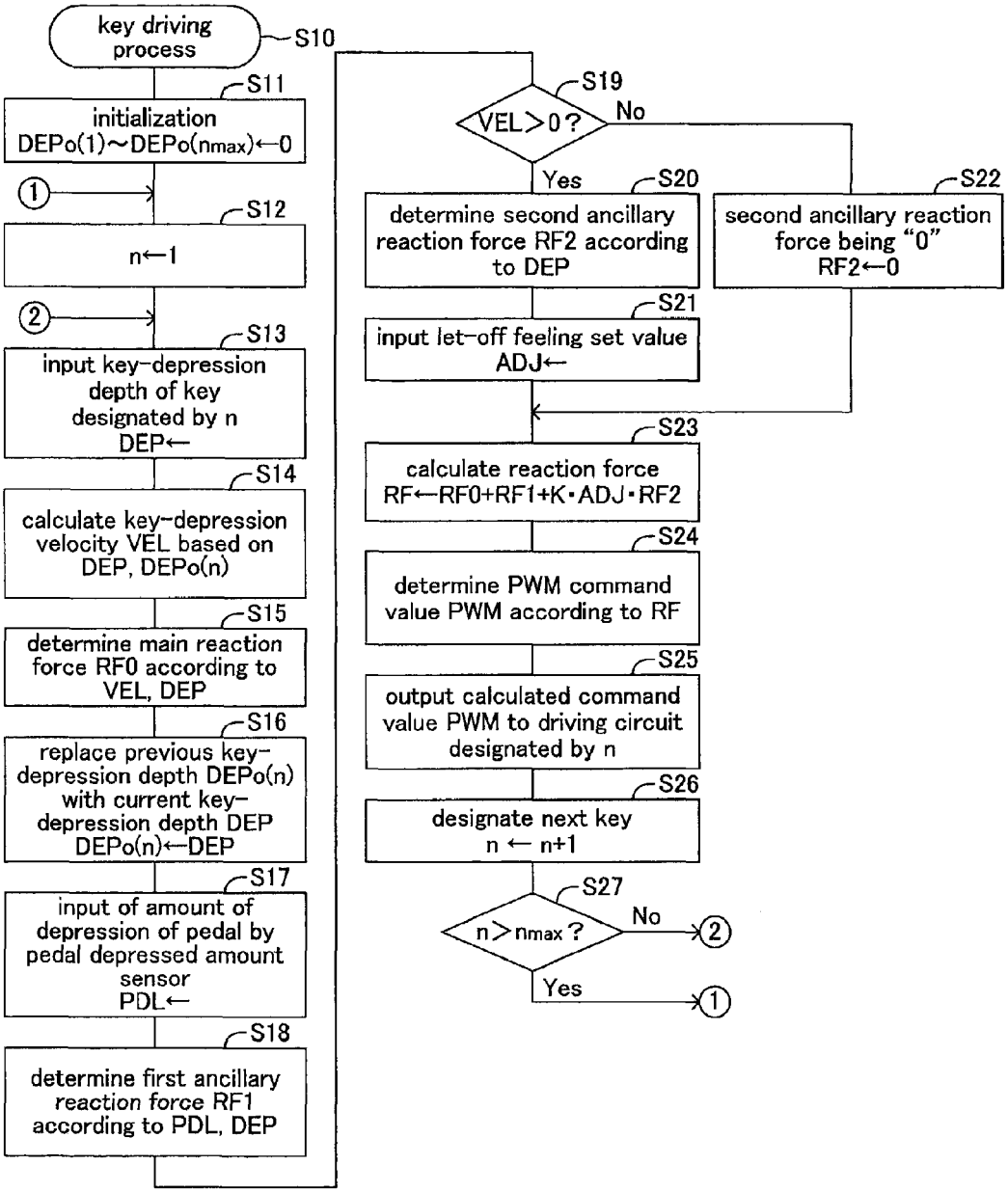
FIG. 3 is a flowchart indicating a program executed by a computer portion shown in FIG. 1.

Next, the operation of the electronic musical instrument configured as described above will be explained. In response to turn-on of a power switch which is not shown, the computer portion 70 carries out a key driving process program indicated in FIG. 3. The key driving process program is started in step S10 of FIG. 3. In step S11, the computer portion 70 initializes respective values of previous key-depression depth DEPo(n) of the respective keys 11 designated by a variable n (n=1, 2 . . . $n_{max}$) to "0". The variable n is used in order to designate one of the keys 11 of the keyboard 10. By a later-described update process on the variable n, the designation of one of the keys 11 of the keyboard 10 is repeated successively. In this embodiment, if the variable n is "1", the lowest key is designated. As the variable n increases by "1", the variable n designates a higher-pitched key. The value $n_{max}$ represents the total number of the keys 11 of the keyboard 10. The previous key-depression depth DEPo(n) represents key-depression depth DEP of the key 11 at the previous processing. In step S12, the computer portion 70 sets the variable n at "1" and then proceeds to step S13 to input the key-depression depth DEP of the key 11 designated by the variable n (=1). More specifically, the computer portion 70 inputs the current key-depression depth DEP which has been sensed by the key-depression depth sensor 26 corresponding to the key 11 designated by the variable n and has been converted into a digital signal by the A/D conversion circuit 27. In step S14, the computer portion 70 calculates key-depression velocity VEL by use of a difference DEP−DEPo(n) between the current key-depression depth DEP and the previous key-depression depth DEPo(n). For the calculation of the key-depression velocity VEL, the computer portion 70 uses a predetermined fixed time required from the input of the previous key-depression depth DEPo(n) to the input of the current key-depression depth DEP or a measured variable time.

In step S15, the computer portion 70 refers to a later-described main reaction force table TB0 to determine main reaction force RF0 representative of part of reaction force RF to be exerted on the key 11 designated by the variable n according to the key-depression velocity VEL and the key-depression depth DEP.

Figure 4A:
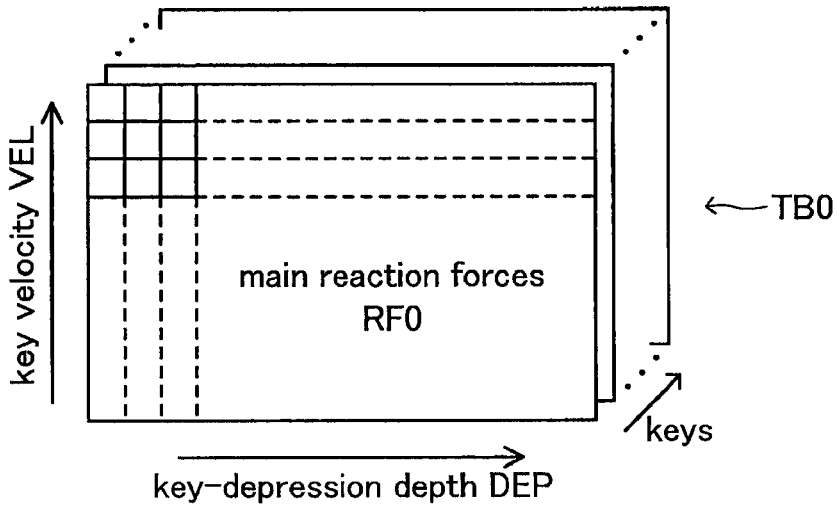
FIG. 4A is a diagram indicating the configuration of main reaction force tables.
Figure 5A:
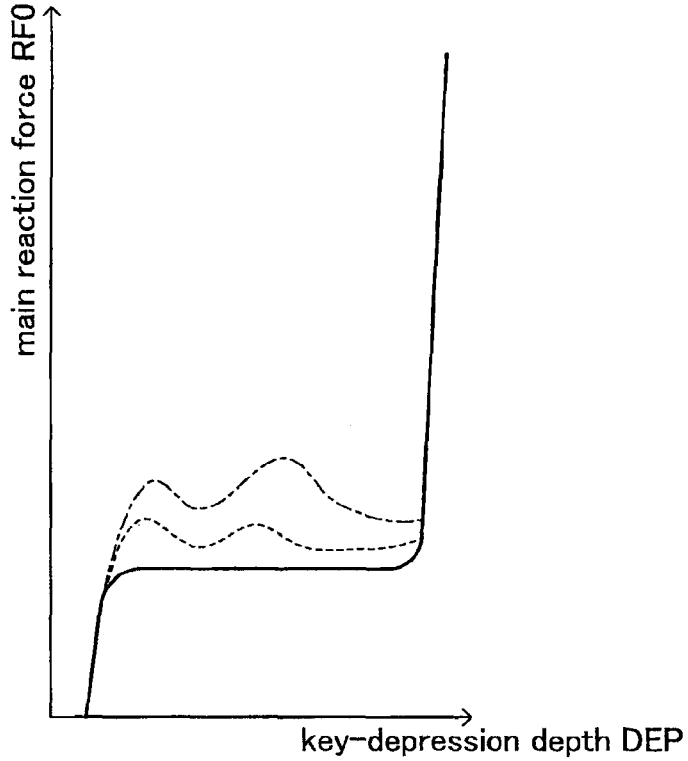
FIG. 5A is a diagram indicating an example conversion characteristic of main reaction force converted on the basis of the depth of key-depression.

The main reaction force tables TB0, which are provided for the keys 11, respectively, are stored in the ROM 70*c*. As indicated in FIG. 4A, each of the main reaction force tables TB0 provided for each of the keys 11 stores main reaction forces RF0 which vary according to the key-depression velocity VEL and the key-depression depth DEP. The main reaction force tables TB0 may be stored in the external storage device 80 so that the main reaction force tables TB0 may be transferred to the RAM 70*b* upon power-up. If the key 11 is depressed, the spring 17 is compressed to increase reaction force exerted by the spring 17. The main reaction force table TB0 defines the main reaction force RF0 in consideration of influence caused by the reaction force exerted by the spring 17. In a case where the front end of the key 11 is urged upward by the weight of a lever, a massive body or the like which moves in response to the key 11 as well, the main reaction force RF0 is defined in consideration of the weight. A solid line of FIG. 5A indicates the conversion characteristic of a case where the key-depression velocity VEL is small. A dashed line of FIG. 5A indicates the conversion characteristic of a case where the key-depression velocity VEL is medium, whereas a dashed dotted line of FIG. 5A indicates the conversion characteristic of a case where the key-depression velocity VEL is great. As a result, the main reaction force RF0 stored in the main reaction force table TB0 increases with increasing key-depression velocity VEL. A depression of a key results in the key-depression velocity VEL having a positive value, whereas a release of a key results in the key-depression velocity VEL having a negative value. By storing the main reaction forces RF0 which vary according to the key-depression velocity VEL ranging from positive values to negative values in the respective main reaction force tables TB0, this embodiment exhibits hysteresis in the reaction force. Furthermore, each main reaction force table TB0 stores the main reaction forces RF0 so that the main reaction forces RF0 are correlated with key-depression velocities VEL and key-depression depths DEP which have certain intervals. For the determination of the main reaction force RF0 in step S15, therefore, the computer portion 70 performs interpolation if necessary. Instead of interpolation, the computer portion 70 may determine, as the main reaction force RF0, a reaction force stored in the main reaction force table TB0 corresponding to the key-depression depth which is closest to the current key-depression depth DEP input in step S10 and the key-depression velocity which is closest to the key-depression velocity VEL calculated in step S14.

In step S16, the computer portion 70 replaces the previous key-depression depth DEPo(n) with the current key-depression depth DEP. The update of the previous key-depression depth DEPo(n) is necessary because after the process of step S14 for the key 11 designated by the variable n followed by the processes of steps S11 to step S27 for the other keys 11, the updated previous key-depression depth DEPo(n) is used for the calculation of the key-depression velocity VEL at the iterated process of step S14 for the key 11 designated by the variable n.

In step S17, the computer portion 70 inputs the amount of depression PDL of the lever 32. More specifically, the computer portion 70 inputs the pedal depressed amount PDL which has been sensed by the pedal depressed amount sensor 38 and converted into a digital signal by the A/D conversion circuit 39. In step S18, the computer portion 70 refers to a later-described first ancillary reaction force table TB1 to determine first ancillary reaction force RF1 representative of part of the reaction force RF to be exerted on the key 11 designated by the variable n according to the pedal depressed amount PDL and the key-depression depth DEP.

Figure 4B:
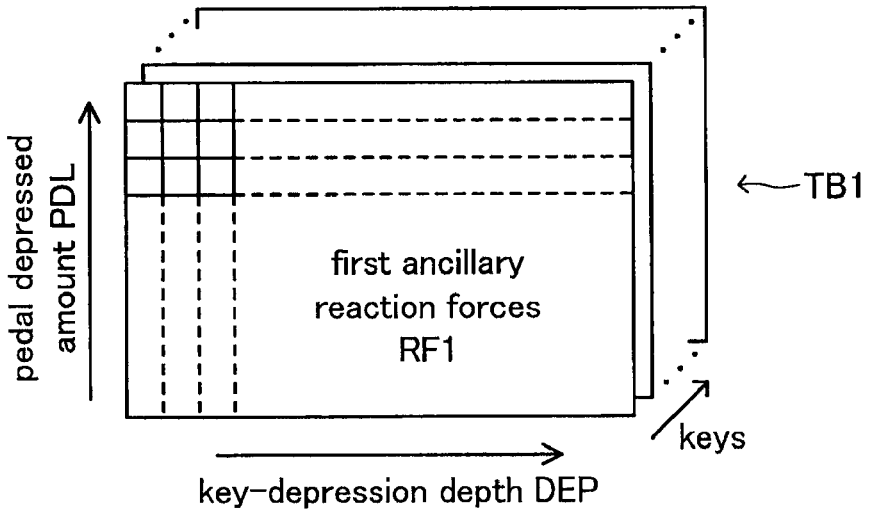
FIG. 4B is a diagram indicating the configuration of first ancillary reaction force tables.
Figure 5B:
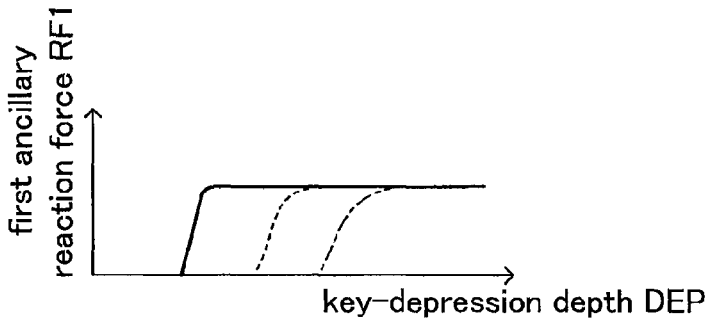
FIG. 5B is a diagram indicating an example conversion characteristic of first ancillary reaction force converted on the basis of the depth of key-depression.

The first ancillary reaction force tables TB1, which are also provided for the keys 11, respectively, are stored in the ROM 70*c*. As indicated in FIG. 4B, each of the first ancillary reaction force tables TB1 provided for each of the keys 11 stores first ancillary reaction forces RF1 which vary according to the pedal depressed amount PDL and the key-depression depth DEP. The first ancillary reaction force tables TB1 may be stored in the external storage device 80 so that the first ancillary reaction force tables TB1 may be transferred to the RAM 70*b* upon power-up. A solid line of FIG. 5B indicates the conversion characteristic of a case where the lever 32 is not being depressed. A dashed line of FIG. 5B indicates the conversion characteristic of a case where the lever 32 is depressed part way, whereas a dashed dotted line of FIG. 5B indicates the conversion characteristic of a case where the lever 32 is depressed more deeply. As for the first ancillary reaction force RF1 stored in the first ancillary reaction force table TB1, the key-depression depth DEP at which the reaction force starts emerging (time required from the start of a key-depression) varies according to the depressed amount PDL. As for the depression of a key, more specifically, the key-depression depth DEP at which the first ancillary reaction force RF1 starts emerging increases with increasing depressed amount PDL. Furthermore, each first ancillary reaction force table TB1 stores the first ancillary reaction forces RF1 so that the first ancillary reaction forces RF1 are correlated with pedal depressed amounts PDL and key-depression depths DEP which have certain intervals. For the determination of the first ancillary reaction force RF1 in step S18, therefore, the computer portion 70 performs interpolation if necessary. Instead of interpolation, the computer portion 70 may determine, as the first ancillary reaction force RF1, a reaction force stored in the first ancillary reaction force table TB1 corresponding to the key-depression depth which is the closest to the current key-depression depth DEP input in step S10 and the amount of depression which is the closest to the depressed amount PDL input in step S17.

In step S19, the computer portion 70 determines whether the player's manipulation of the key 11 is a manipulation of depressing the key or a manipulation of releasing the key. If the key-depression velocity VEL is greater than "0", the computer portion 70 makes a positive determination in step S19 (i.e., a depression of the key) to proceed to step S20. If key-depression velocity VEL is "0" or less, the computer portion 70 makes a negative determination in step S19 (i.e., a release of the key) to proceed to step S22.

Figure 4C:
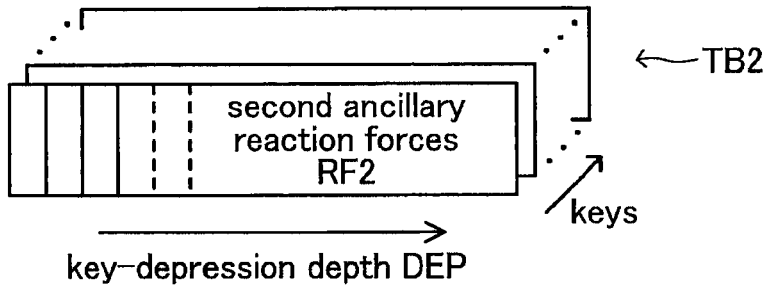
FIG. 4C is a diagram indicating the configuration of second ancillary reaction force tables.
Figure 5C:
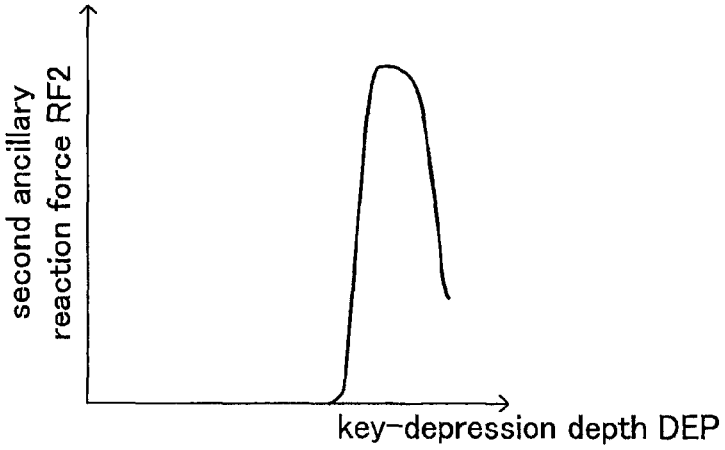
FIG. 5C is a diagram indicating an example conversion characteristic of second ancillary reaction force converted on the basis of the depth of key-depression.
Figure 6:
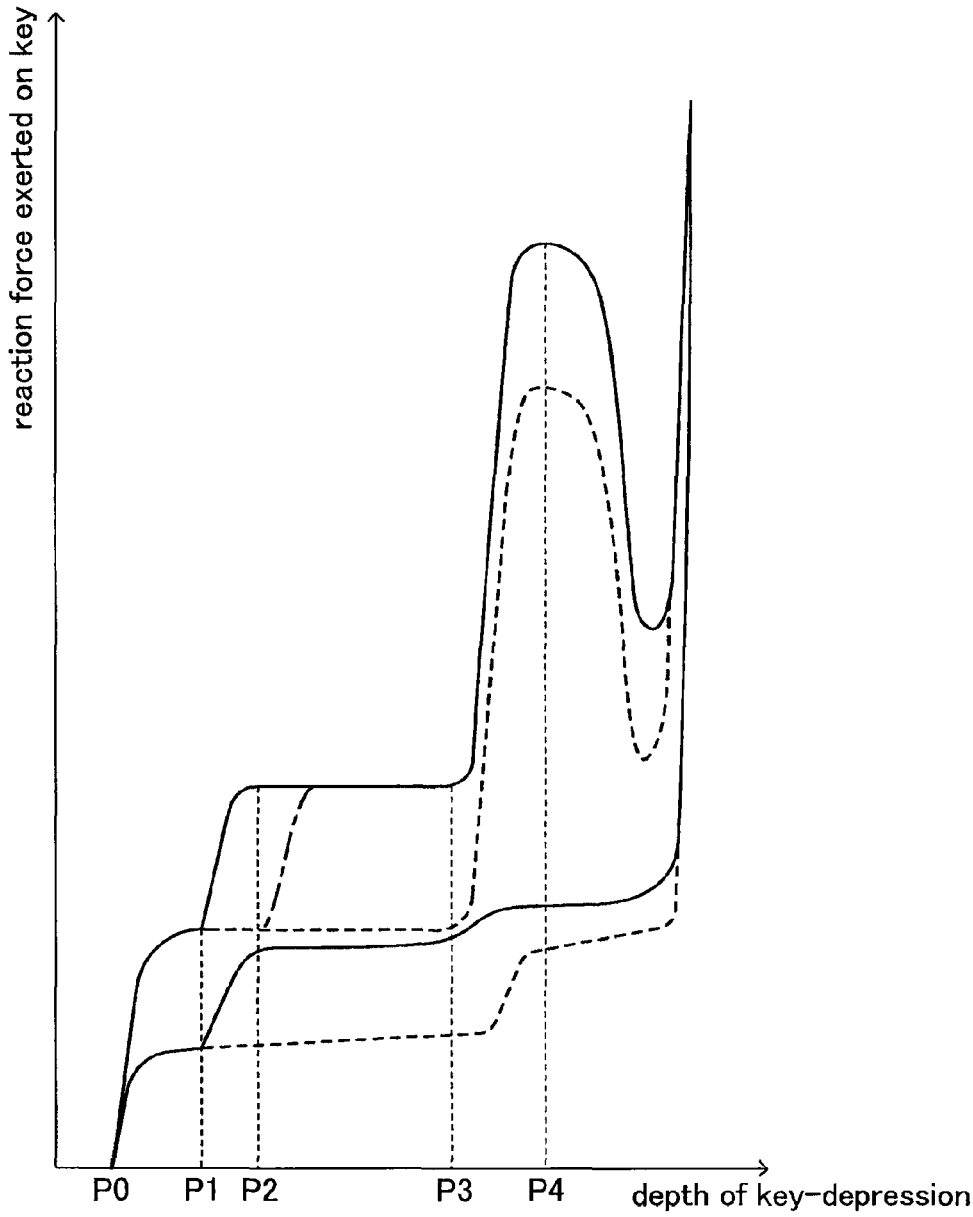
FIG. 6 is a diagram indicating characteristic of reaction force with respect to the depth of key-depression of an acoustic piano.

In step S20, the computer portion 70 refers to a second ancillary reaction force table TB2 to determine second ancillary reaction force RF2 representative of part of the reaction force RF to be exerted on the key 11 designated by the variable n according to the key-depression depth DEP. The second ancillary reaction force tables TB2, which are also provided for the keys 11, respectively, are also stored in the ROM 70*c*. As indicated in FIG. 4C, each of the second ancillary reaction force tables TB2 provided for each of the keys 11 stores second ancillary reaction forces RF2 which vary according to the key-depression depth DEP. The second ancillary reaction force tables TB2 may be stored in the external storage device 80 so that the second ancillary reaction force tables TB2 may be transferred to the RAM 70*b* upon power-up. The second ancillary reaction force RF2 is equivalent to a reaction force for the key 11 caused by an escapement action of an acoustic piano. As indicated in FIG. 5C, therefore, a certain range of the key-depression depth DEP (e.g., a range of 6 mm to 7 mm) yields large reaction force values, however, the other ranges yield a reaction force value of "0". Furthermore, each second ancillary reaction force table TB2 stores the second ancillary reaction forces RF2 so that the second ancillary reaction forces RF2 are correlated with key-depression depths DEP which have certain intervals. For the determination of the second ancillary reaction force RF2 in step S20, therefore, the computer portion 70 performs interpolation if necessary. Instead of interpolation, the computer portion 70 may determine, as the second ancillary reaction force RF2, a reaction force stored in the second ancillary reaction force table TB2 corresponding to the key-depression depth which is the closest to the current key-depression depth DEP input in step S10.

In a case where the computer portion 70 determines in step S19 that the player's manipulation was a "release of the key", the computer portion 70 sets the second ancillary reaction force RF2 at "0" in step S22. As described above, this is because a reaction force attributed to the escapement action of an acoustic piano is generated only on the depression of a key.

In step S21, the computer portion 70 obtains a value set by use of the let-off feeling setting operator 41. More specifically, the computer portion 70 inputs let-off feeling set value ADJ which has been converted into a digital signal by the A/D conversion circuit 43.

In step S23, the computer portion 70 performs following equation 1 to calculate the reaction force RF.

$$RF=RF0+RF1+k\cdot ADJ\cdot RF2 \qquad \text{Eq. 1}$$

In the Eq. 1, the computer portion 70 multiplies the second ancillary reaction force RF2 determined by referring to the second ancillary reaction force table TB2 by the let-off feeling set value ADJ. This process is equivalent to a scale-up or scale-down of the conversion characteristic indicated in FIG. 5C on the axis of the second ancillary reaction force RF2. By varying the magnitude of the second ancillary reaction force RF2 according to the let-off feeling set value ADJ, therefore, this embodiment is capable of varying the magnitude of the let-off feeling which is to be perceived by the player. In the Eq. 1, "k" indicates a constant which has been predetermined in order to adjust gain of the reaction force RF with respect to variations in the let-off feeling set value ADJ.

Figure 4D:
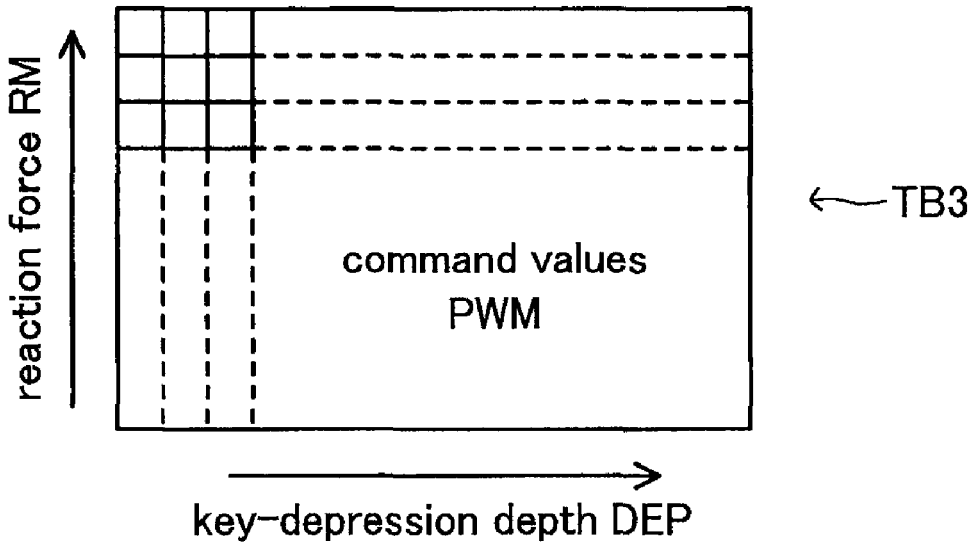
FIG. 4D is a diagram indicating the configuration of a command value table.

In step S24, the computer portion 70 refers to a later-described command value table TB3 to determine command value PWM for controlling the driving circuit 22. The command value PWM indicates a duty ratio for a PWM signal generated by the driving circuit 22. The command value table TB3, which is stored in the ROM 70*c*, stores command values PWM which vary according to the reaction force RF and the key-depression depth DEP, as indicated in FIG. 4D. The command value table TB3 may be stored in the external storage device 80 so that the command value table TB3 may be transferred to the RAM 70*b* upon power-up. In general, even if a constant amount of current is supplied to coils of a solenoid, thrust applied to a plunger can vary depending on the position of the plunger. By using the command value table TB3 which stores command values PWM that vary according to the key-depression depth DEP as well, therefore, this embodiment corrects characteristic of varying thrust of the solenoid according to the above-described duty ratio to exert a target reaction force RF on the key 11. In step S25, the computer portion 70 outputs the command value PWM to the driving circuit 22 of the key 11 designated by the variable n. The driving circuit 22 generates a PWM signal on the basis of the command value PWM to control the solenoid 21 so that a reaction force applied by the solenoid 21 in order to oppose the player's key manipulation will be the reaction force RF.

In step S26, the computer portion 70 updates the variable n. More specifically, the computer portion 70 adds "1" to the variable n. In step S27, the computer portion 70 determines whether the variable n exceeds the total number $n_{max}$ of the keys 11 of the keyboard 10.

In this case, because the variable n has been set at "1", the variable n is updated to "2". Therefore, the computer portion 70 makes a negative determination in step S27 to return to step S13. Then, the computer portion 70 performs the processes of steps S13 to S25 for the key 11 designated by the variable n (=2) (i.e., the next higher key 11) to exert the reaction force RF on the key 11. After the processes of steps S13 to S25, the computer portion 70 increases the variable n by "1" again in step S26 to make a negative determination in step S27 to perform the processes of steps S13 to S25 again. By such repetitions of the processes of steps S13 to S25 with an increase in the variable n by "1" for each repetition, a reaction force is imparted to each of the keys 11 one by one from the lowest key toward the higher-pitched keys. When the variable n is the total number $n_{max}$ to terminate the processes of steps S13 to S25 for the key 11 designated by the variable n (=$n_{max}$) (i.e., the highest key 11), the reaction control over all the keys 11 of the keyboard 10 is completed. As for the keys 11 which are not being depressed, the key-depression depth is "0" with the main reaction force RF0, the first ancillary reaction force RF1 and the second ancillary reaction force RF2 also being "0", resulting in the reaction force RF also being "0". Therefore, the solenoids 21 of such keys will not substantially apply any reaction force to the keys.

If the process of updating the variable n in step S26 results in the variable n being $n_{max}+1$, the computer portion 70 makes a positive determination in step S27, that is, determines that the variable n exceeds the total number $n_{max}$ to return to step S12. In step S12, as described above, the variable n is set to "1" again. After the set of the variable n, the computer portion 70 keeps repeating the loop consisting of steps S13 to S27 again. As a result, the reaction force control is kept performed repeatedly for all the keys 11 of the keyboard 10.

The electronic musical instrument configured as described above is provided with the main reaction force tables TB0 which store the main reaction forces RF0 that vary according to the key-depression velocity VEL and the key-depression depth DEP. The electronic musical instrument is also provided with the first ancillary reaction force tables TB1 which store the first ancillary reaction forces RF1 that vary according to the pedal depressed amount PDL of the damper pedal and the key-depression depth DEP. Furthermore, the electronic musical instrument is configured to obtain the main reaction force RF0 and the first ancillary reaction force RF1 by use of the main reaction force table TB0 and the first ancillary reaction force table TB1. As a result, the electronic musical instrument of the embodiment is able to reproduce the reaction force characteristic not only of the on-state and the off-state of the damper pedal but also of the half-pedal state of the damper pedal. Compared with the above-described conventional electronic musical instrument which is provided with tables equivalent to the main reaction force tables TB0 of the present invention for the on-state and the off-state of the damper pedal, respectively, to switch the tables depending on on/off of the damper pedal, the electronic musical instrument of this embodiment realizes simple table configuration even in a case where only the two states of on/off states of the damper pedal are employed as the pedal depressed amount PDL.

The electronic musical instrument of this embodiment is also provided with the second ancillary reaction force tables TB2 which store the second ancillary reaction forces RF2 that vary according to the key-depression depth DEP. In addition, the electronic musical instrument is designed to determine the second ancillary reaction force RF2 by use of the second ancillary reaction force table TB2 to multiply the second ancillary reaction force RF2 by the let-off feeling set value ADJ. As a result, because the electronic musical instrument is able to increase/decrease the reaction force RF in a certain range of the key-depression depth DEP (a range of key-depression depth DEP within which the second ancillary reaction force RF2 is applied) on a key-depression, the electronic musical instrument is able to reproduce different magnitudes of the let-off feeling caused by variations in the escapement action of various acoustic pianos. Furthermore, the electronic musical instrument enables the player to manipulate the let-off feeling setting operator 41 to control the magnitude of the let-off feeling. Moreover, the second ancillary reaction force tables TB2 are designed to have only the key-depression depth DEP as a parameter, resulting in the simple table configuration.

The present invention is not limited to the above-described embodiment but may be variously modified without departing from the object of the invention.

For example, the above-described embodiment is designed such that the computer portion 70 refers to the second ancillary reaction force table TB2 by use of the key-depression depth DEP to determine the second ancillary reaction force RF2 to multiply the second ancillary reaction force RF2 by the let-off feeling set value ADJ to increase/decrease the second ancillary reaction force RF2 to control the magnitude of the let-off feeling. Instead of this scheme or in addition to this scheme, however, the embodiment may be modified such that the key-depression depth DEP is changed according to the let-off feeling set value ADJ to refer to the second ancillary reaction force table TB2 by use of the changed key-depression depth DEP to determine the second ancillary reaction force RF2. For instance, the computer portion 70 may reduce the sensed key-depression depth DEP according to the let-off feeling set value ADJ to refer to the second ancillary reaction force table TB2 to determine the second ancillary reaction force RF2 which corresponds to the reduced key-depression depth DEP. Such processing of changing the key-depression depth DEP is equivalent to a parallel move of the reaction force characteristic of the second ancillary reaction force RF2 indicated in FIG. 5C along the axis of the key-depression depth DEP. Such a configuration enables adjustment of the key-depression depth DEP at which the let-off feeling arises. In addition to the embodiment, the electronic musical instrument may be also provided with a let-off generation position setting operator for moving the reaction force characteristic of the second ancillary reaction force RF2 in parallel along the axis of the key-depression depth DEP to change, according to a set value of the let-off generation position setting operator, the key-depression depth DEP used for the reference to the second ancillary reaction force table TB2. Such a configuration enables separate control over the magnitude of the let-off feeling and the key-depression depth DEP at which the let-off felling is generated.

Furthermore, the above-described embodiment is configured such that the main reaction force table TB0, the first ancillary reaction force table TB1 and the second ancillary reaction force table TB2 are provided for each key. Instead of this configuration, however, this embodiment may be modified such that the keys 11 forming the keyboard 10 are divided into a plurality of groups each containing a certain number of keys (e.g., each octave) so that the ROM 70*c* may store the main reaction force tables TB0, the first ancillary reaction force tables TB1, and the second ancillary reaction force tables TB2 for respective representative keys 11 of the respective groups. In addition, the main reaction force tables TB0, the first ancillary reaction force tables TB1 and the second ancillary reaction force tables TB2 may be stored in the external storage device 80 so that the main reaction force tables TB0, the first ancillary reaction force tables TB1, and the second ancillary reaction force tables TB2 may be transferred from the external storage device 80 to the RAM 70*b* upon power-up. As for the main reaction force RF0, the first ancillary reaction force RF1 and the second ancillary reaction force RF2 for the target key 11 which is placed between the representative keys 11 of the groups, respective conversion tables TB0, TB1 and TB2 provided for the representative keys 11 situated on the both sides of the target key 11 may be used to obtain the main reaction force RF0, the first ancillary reaction force RF1 and the second ancillary reaction force RF2 for the target key 11 by linear interpolation. Such a modified scheme to obtain the main reaction force RF0, the first ancillary reaction force table TB1 and the second ancillary reaction force table TB2 by linear interpolation by use of the thinned-out reaction force conversion data which forms the respective conversion tables TB0, TB1, TB2 reduces the amount of data stored in the respective conversion tables TB0, TB1, TB2, also contributing to significant reduction in the amount of storage of the ROM 70*c* or the external storage device 80.

The above-described embodiment is designed such that each second ancillary reaction force table TB2 is a two-dimensional table in which only the key-depression depth DEP is the parameter. However, each second ancillary reaction force table TB2 may be a three-dimensional table in which the let-off feeling set value ADJ as well as the key-depression depth DEP is the parameter. Such a configuration of the table enables more specific control over the characteristic of the second ancillary reaction force RF2, providing the player with a sense of manipulating a key which is closer to that provided by an acoustic piano.

The above-described embodiment employs the key-depression depth DEP as a parameter used for the main reaction force tables TB0, the first ancillary reaction force tables TB1, the second ancillary reaction force tables TB2 and the command value table TB3. However, the embodiment may employ a pivoting angle of the key 11 as the key-depression depth DEP. As for the key-depression velocity VEL employed as a parameter of the main reaction force tables TB0, furthermore, the pivoting angular velocity of the key 11 may be employed as the key-depression velocity VEL. Instead of the key-depression velocity VEL or in addition to the key-depression velocity VEL, furthermore, a key-depression acceleration or a pivoting angular acceleration as key-depression acceleration may be employed. In order to simplify the main reaction force tables TB0, furthermore, only the key-depression depth DEP may be employed as a parameter. As for the pedal depressed amount PDL employed as a parameter of the first ancillary reaction force tables TB1 as well, the pivoting angle of the lever 32 may be employed as the pedal depressed amount PDL. In addition, the pivoting angular velocity or pivoting angular acceleration of the lever 32 or the like may be employed as a parameter. In order to simplify the main reaction force tables TB0 as much as possible, each main reaction force table TB0 may store the main reaction forces RF0 which vary according to at least the key-depression depth DEP, the key-depression velocity VEL or the key-depression acceleration as a physical quantity concerning manipulation of a key.

Furthermore, the above-described embodiment is designed such that in order to reproduce the reaction force characteristic of acoustic piano which varies according to the amount of manipulation of a key, the amount of depression of a damper pedal and the let-off mechanism, the electronic musical instrument is provided with the main reaction force tables TB0, the first ancillary reaction force tables TB1 and the second ancillary reaction force tables TB2. However, acoustic pianos of some models are provided with not only the damper mechanism and the let-off mechanism but also a mechanism for affecting a reaction force exerted on a key according to the amount of manipulation of the mechanism. In order to deal with such a case, the electronic musical instrument of this embodiment may be also provided with ancillary reaction force tables which store reaction forces for the keys, the reaction forces being caused by the mechanism other than the damper mechanism and the let-off mechanism. The electronic musical instrument of such a modified embodiment provides the player with a sense of manipulating a key which is closer to that provided by an acoustic piano of such a model.

Furthermore, the above-described embodiment is designed such that the computer portion 70 inputs the let-off feeling set value ADJ in step S21. More specifically, the computer portion 70 inputs the let-off feeling set value ADJ for each key 11. Instead of this scheme, however, the computer portion 70 may input the let-off feeling set value ADJ for each certain key range (e.g., each octave). More specifically, the computer portion 70 may calculate the reaction forces RF for the keys 11 belonging to a certain key range by use of a let-off feeling set value ADJ which is shared by the keys 11 of this key range, updating the let-off feeling set value ADJ when the computer portion 70 moves to the processing for the key 11 belonging to the next key range. Furthermore, the computer portion 70 may input a let-off feeling set value ADJ before entering iterated processing for the key 11 designated by the variable n=1 (i.e., the lowest key) after the processing for the key 11 designated by the variable $n=n_{max}$ (i.e., the highest key). In this scheme, that is, during the processing for the keys ranging from the lowest key to the highest key, the computer portion 70 calculates the respective reaction forces RF of the respective keys by use of the let-off feeling set value ADJ which is shared by these keys during the processing, and then updates the let-off feeling set value ADJ before moving into the processing for the lowest key after the completion of the processing for the highest key. Furthermore, the embodiment may be modified such that the computer portion 70 inputs the let-off feeling set value ADJ each time the series of processing for the lowest key to the highest key is repeated a certain number of times (e.g., five).

What is claimed is:

1. An electronic musical instrument having:

a key manipulated by a player;

a physical quantity sensor for sensing physical quantity concerning manipulation of the key;

a reaction force applying device for applying a reaction force opposing the player's manipulation of the key to the key;

an operator manipulated by the player to affect manipulation of the key according to the amount of manipulation of the operator;

an operator manipulated amount sensor for sensing the amount of manipulation of the operator;

a main reaction force determining portion for determining, by use of a main reaction force table storing main reaction forces which vary according to the physical quantity concerning manipulation of the key, a main reaction force corresponding to the sensed physical quantity concerning manipulation of the key;

a first ancillary reaction force determining portion for determining, by use of a first ancillary reaction force table storing first ancillary reaction forces which vary according to the physical quantity concerning manipulation of the key and the amount of manipulation of the operator, a first ancillary reaction force corresponding to the sensed physical quantity concerning manipulation of the key and the sensed amount of manipulation of the operator; and a reaction force controller for adding the determined first ancillary reaction force to the determined main reaction force to calculate a composite reaction force to control the reaction force applying device on the basis of the composite reaction force so that the reaction force opposing the player's manipulation of the key will be the composite reaction force.

2. An electronic musical instrument according to claim 1, wherein the reaction force applying device includes a solenoid.

3. An electronic musical instrument according to claim 1, wherein the operator is a damper pedal; and the amount of manipulation of the operator is the amount of depression of the damper pedal.

4. An electronic musical instrument according to claim 3, wherein the physical quantity concerning manipulation of the key is depth of a depression of the key; and the first ancillary reaction forces are designed such that the depth of a depression of the key at which the first ancillary reaction force starts to emerge varies according to the amount of depression of the damper pedal.

5. An electronic musical instrument according to claim 4, wherein the first ancillary reaction force determined by the first ancillary reaction force determining portion is used for reproducing characteristic of reaction force of a key of an acoustic piano by depression of a damper pedal of the acoustic piano.

6. An electronic musical instrument according to claim 1, wherein the physical quantity concerning manipulation of the key is depth of a depression of the key and velocity of the depression of the key or acceleration of the depression of the key.

7. An electronic musical instrument according to claim 1 further comprising:

a second ancillary reaction force determining portion for determining, by use of a second ancillary reaction force table storing second ancillary reaction forces which vary according to the physical quantity concerning manipulation of the key, a second ancillary reaction force corresponding to the sensed physical quantity concerning manipulation of the key, wherein the physical quantity concerning manipulation of the key is depth of a depression of the key, and the reaction force controller adds the determined second ancillary reaction force to the composite reaction force to calculate a new composite reaction force to control the reaction force applying device on the basis of the new composite reaction force so that the reaction force opposing the player's manipulation of the key will be the new composite reaction force.

8. An electronic musical instrument according to claim 7, wherein the second ancillary reaction forces stored in the second ancillary reaction force table are equivalent to a reaction force for the key caused by an escapement action of an acoustic piano.

9. An electronic musical instrument according to claim 7, wherein the second ancillary reaction forces stored in the second ancillary reaction force table are large in a certain range of the depth of the depression of the key.

10. An electronic musical instrument according to claim 7 further comprising:

a setting operator for adjusting the reaction force opposing the player's manipulation of the key, wherein the second ancillary reaction force determining portion has a varying portion for varying the second ancillary reaction force determined by use of the second ancillary reaction force table according to a manipulated state of the setting operator.

11. An electronic musical instrument according to claim 10, wherein the varying portion varies magnitude of the second ancillary reaction force determined by use of the second ancillary reaction force table according to the manipulated state of the setting operator after determining the second ancillary reaction force by use of the second ancillary reaction force table.

12. An electronic musical instrument according to claim 10, wherein the varying portion varies magnitude of the sensed depth of the depression of the key according to the manipulated state of the setting operator before determining the second ancillary reaction force by use of the second ancillary reaction force table.

* * * * *